US007573200B2

(12) United States Patent
Yamamoto et al.

(10) Patent No.: US 7,573,200 B2
(45) Date of Patent: Aug. 11, 2009

(54) PLASMA DISPLAY PANEL

(75) Inventors: Shinichi Yamamoto, Osaka (JP); Mikihiko Nishitani, Nara (JP); Yukihiro Morita, Osaka (JP)

(73) Assignee: Panasonic Corporation, Osaka (JP)

( * ) Notice: Subject to any disclaimer, the term of this patent is extended or adjusted under 35 U.S.C. 154(b) by 371 days.

(21) Appl. No.: 10/577,979

(22) PCT Filed: Nov. 10, 2004

(86) PCT No.: PCT/JP2004/016654

§ 371 (c)(1),
(2), (4) Date: May 1, 2006

(87) PCT Pub. No.: WO2005/045872

PCT Pub. Date: May 19, 2005

(65) Prior Publication Data

US 2007/0080641 A1 Apr. 12, 2007

(30) Foreign Application Priority Data

Nov. 10, 2003 (JP) ..... 2003-379730
Oct. 20, 2004 (JP) ..... 2004-305185

(51) Int. Cl.
*H01J 1/62* (2006.01)
*H01J 17/49* (2006.01)

(52) U.S. Cl. ..... 313/587; 313/582; 313/583; 313/584; 313/585; 313/586; 313/309; 313/336; 313/351; 313/311; 315/169.1; 315/169.4; 345/37; 345/41; 345/60; 345/71

(58) Field of Classification Search ..... 313/582, 313/583, 584, 585, 586, 587; 315/169.1, 315/169.4; 345/37, 41, 60, 71
See application file for complete search history.

(56) References Cited

U.S. PATENT DOCUMENTS 5,872,422 A * 2/1999 Xu et al. ..... 313/311
6,346,775 B1 2/2002 Lee et al.
6,642,639 B2 * 11/2003 Choi et al. ..... 313/309
2002/0060514 A1 * 5/2002 Nakamoto ..... 313/311

FOREIGN PATENT DOCUMENTS

EP 0325797 A1 * 2/1989

(Continued)

OTHER PUBLICATIONS

Machine translation of JP 2002-117771 is included.*

(Continued)

*Primary Examiner*—Toan Ton
*Assistant Examiner*—Zachary Snyder

(57) ABSTRACT

An object of the present invention is to reduce power consumption in a plasma display panel (PDP) by reducing the discharge firing voltage, while suppressing the occurrence of discharge variability when the PDP is driven, as well as ensuring the wall-charge holding performance of a protective film surface. To achieve this, a front panel of a PDP of the present invention has a catalyst layer dispersed on a surface of display electrodes formed in stripes on one side of a glass substrate, and needle crystals composed of graphite formed to stand upright on the catalyst layer. The needle crystals form a phase-separated structure with the materials of a dielectric film and a protective film.

15 Claims, 10 Drawing Sheets

FOREIGN PATENT DOCUMENTS

| | | |
|---|---|---|
| JP | 07-037510 | 2/1995 |
| JP | 08-339767 | 12/1996 |
| JP | 2000-164141 | 6/2000 |
| JP | 2001-220674 | 8/2001 |
| JP | 2001-222944 | 8/2001 |
| JP | 2002-117771 | 4/2002 |
| JP | 2004-335406 | 11/2004 |
| WO | WO2004/086449 | * 10/2004 |

OTHER PUBLICATIONS

EP 0325797 A1 provided.*
WO2004/086449 provided.*
Whikun Yi et al.; Secondary Electron Emission Yields from MgO deposited on Carbon Nanotubes; Journal of Applied Physics; vol. 89, No. 7; 2001 American Institute of Physics.

* cited by examiner

PLASMA DISPLAY PANEL

TECHNICAL FIELD

The present invention relates to a plasma display panel, and more particularly to an AC surface discharge plasma display panel.

BACKGROUND ART

CRTs remain the typical self-luminous image display device, although plasma display panels (PDPs) are rapidly becoming widespread given the relative ease with which large, thin panels can be manufactured. While there are both alternative current (AC) PDPs and direct current (DC) PDPs, AC PDPs are superior in a number of respects including reliability and image quality, with three-electrode surface discharge PDPs in particular becoming widespread.

A three-electrode surface discharge PDP is constituted from a front substrate disposed parallel to a back substrate with a space therebetween. A plurality of display electrode pairs (scan and sustain electrodes) are formed in stripes on one side of the front substrate, with a dielectric film and a protective film layered to cover the electrode pairs. On the other hand, a plurality of data electrodes are formed in stripes on one side of the back substrate, with a dielectric film layered to cover the data electrodes. Barrier ribs are formed on the dielectric film between adjacent data electrodes, and a phosphor film is applied over the surface of the dielectric film and the sidewalls of the barrier ribs. Discharge cells are formed where the display electrode pairs and the data electrodes intersect in three-dimensional space, and image display is performed as a result of discharge emissions produced in discharge cells following the application of voltages to the electrodes.

Here, the display electrode pairs mostly adopt a structure in which each electrode is composed of a metal bus electrode layered on a transparent electrode in order to reduce electrical resistance. Furthermore, the protective film works to decrease the discharge voltage through the efficient emission of secondary electrons in the discharge cells, as well as to protect the display electrodes and dielectric film from high energy ions produced by the discharges. Moreover, the protective film is also required to hold wall charge on the surface thereof.

Magnesium oxide (MgO), combining excellent anti-sputtering characteristics with a large secondary electron emission coefficient, is generally employed as the material for the protective film formed in a thin-film process.

Reducing power consumption and suppressing discharge variability remain ongoing problems to be resolved in PDPs having the above features, with attempts having been made to resolve these problems from the angle of panel structure, drive method, and materials.

For example, patent document 1 discloses a PDP with a two-tiered structure in which a carbon nanotube (hereinafter "CNT") layer and an MgO layer are sequentially layered over a dielectric film on the back substrate in order to improve the secondary electron emission coefficient. Thus, by forming an MgO layer over a CNT layer, MgO adheres to the unevenness of the CNT surface, increasing the surface area in comparison to a protective film made only from MgO, and dramatically increasing the secondary electron emission coefficient.

Increasing the secondary electron emission coefficient of the protective film in this way is considered effective in reducing the discharge firing voltage and improving luminous efficiency.

Patent Document 1: Japanese Patent Application Publication No. 2001-222944

DISCLOSURE OF THE INVENTION

Problems Solved by the Invention

However, in a PDP with a two-tiered protective film as described above, the MgO layer needs to be formed thinly over the CNT layer for sufficient unevenness to be formed on the surface of the MgO layer to allow for an increase in the secondary electron emission coefficient. This is undesirable in terms of the reduced quality of displayed images resulting from the increased likelihood of discharge variability when the PDP is driven, due to variability in secondary electron emission performance per discharge cell caused by patchiness in the application of the MgO layer.

An object of the present invention is to reduce power consumption in a PDP by reducing the discharge firing voltage, while suppressing the occurrence of discharge variability when the PDP is driven, as well as ensuring the wall-charge holding performance of the protective film surface.

Means to Solve Problems

To achieve this object, the preset invention is a plasma display panel (PDP) that includes a front substrate and a back substrate facing each other with a space therebetween, the front panel having a plurality of electrodes disposed on a main surface thereof, and a dielectric film and a protective film formed sequentially to cover the electrodes, and luminescent display being performed by applying a voltage to the electrodes to cause a discharge in the space between the substrates. The PDP is characterized in that a plurality of needle crystals composed of a conductive substance or a semiconductor substance are disposed to penetrate at least one of the dielectric film and the protective film in a thickness direction.

Here, the needle crystals desirably stand substantially perpendicular to the main surface of the front substrate, and the materials of the protective film and the dielectric film desirably are layered to completely fill the gaps between the needle crystals. Furthermore, a phase-separated structure desirably is formed with the dielectric film material and the needle crystals.

In particular, the needle crystals preferably are disposed substantially perpendicular to the main surface of the front substrate to penetrate the dielectric film in a thickness direction, and the dielectric film material and the protective film material preferably are layered to completely fill the gaps between the needle crystals.

Graphite crystals preferably are employed as the needle crystals. CNT, graphite nanofiber (GNF) and diamond-like carbon (DLC) are suitable as the graphite crystals.

Tetrapod-shaped particles may also be employed as the needle crystals.

Effects of the Invention

According to a PDP of the present invention, the amount of secondary electron emission produced when high energy ions and electrons collide with the protective film increases through the action of the needle crystals disposed to penetrate the dielectric film or the protective film in a thickness direction. Consequently, power consumption can be greatly reduced because of the increased luminous efficiency, as well as contributing to the reduction in discharge firing voltage and the suppression of discharge variability in the PDP.

Here, an excellent reduction in the discharge firing voltage is achieved, because electrons are efficiently emitted by disposing the needle crystals substantially perpendicular to the main surface of the front substrate, and layering the materials of the protective film and the dielectric film to completely fill the gaps between the needle crystals, and also by forming a phase-separated structure with the dielectric film and the needle crystals.

Electrons are supplied from the electrodes to the discharge space via the needle crystals following the application of a voltage to the electrodes, particularly in the case where the needle crystals are disposed substantially perpendicular to the main surface of the front substrate to penetrate the dielectric film in a thickness direction, and the dielectric film material and the protective film material are layered to completely fill the gaps between the needle crystals. In this way, the discharge firing voltage and discharge variability can be reduced, evenly through the action of electrons supplied to the discharge space via the needle crystals when a voltage is applied to the electrodes.

Here, electrons are supplied directly to the discharge space in the case where the tips of the needle crystals are exposed in the discharge space. However, even if the tips of the needle crystals are buried in the protective film rather than being exposed in the discharge space, cracks normally form in the protective film between crystals constituting the protective film, thus allowing for electrons to be supplied from the tips of the needle crystals to the discharge space through these cracks. Also, burying the tips of the needle crystals in the protective film improves durability.

On the other hand, with the PDP of the present invention, the protective film remains insulated from the electrodes in areas of the dielectric film other than those penetrated by the needle crystals, thereby enabling the wall-charge holding performance of the protective film surface over these areas to be ensured.

Furthermore, since the surface area of the protective film does not need to be enlarged by creating surface unevenness, the protective film need not be thinly formed. Consequently, patchiness in the formation of the protective film can be eliminated, and variability in secondary electron emission performance can also be suppressed.

Therefore, according to the present invention, the discharge firing voltage can be reduced, while ensuring the wall-charge holding performance, as well as suppressing discharge variability.

Graphite crystals preferably are employed as the needle crystals.

In this case, by interposing a metal layer composed of one or a plurality of metals selected from the group consisting of nickel (Ni), iron (Fe), and cobalt (Co) between the dielectric film and the graphite crystals or between the electrodes and the graphite crystals, needle-like graphite crystals can be readily grown in an upright position relative to the substrate surface, using a method in which the metal layer is formed on the dielectric film or the electrode surface above the substrate and the graphite crystals are deposited on this metal layer. Specifically, graphite crystals can be grown to be substantially perpendicular to the substrate at a relatively low temperature using a plasma chemical vapor deposition (CVD) technique that employs ethylene as the raw material gas.

Furthermore, the bundle size and surface density of the graphite crystals can be adjusted by changing the shape in which the metal layer is formed.

CNT, GNF and DLC are suitable as the graphite crystals.

By employing tetrapod-shaped particles as the needle crystals, the needle crystals can be readily disposed in an upright position relative to the substrate surface using a method in which the needle crystal particles are applied on the dielectric film or the electrode surface.

Zinc oxide (ZnO) preferably is employed as the tetrapod-shaped particles.

In the case where the electrodes disposed on the front substrate include display electrode pairs, an excellent reduction in discharge firing voltage is achieved by disposing needle crystals on one or both of the electrodes in each pairs.

If the electrodes disposed on the front substrate include display electrode pairs and electron emitting electrodes formed between the display electrodes in each pair, the discharge firing voltage is reduced even if the needle crystals are disposed on the electron emitting electrodes.

In this case, the electron emitting electrodes preferably are held at ground potential or floating potential while applying a sustain voltage to the display electrodes, when generating the sustain discharge.

In the present invention, the protective film preferably is formed using a metal oxide selected from the group consisting of MgO, calcium oxide (CaO), strontium oxide (SrO) and barium oxide (BaO), or a compound of these metal oxides.

DESCRIPTION OF REFERENCE SIGNS

10 Front Panel
11 Back Substrate
12 Display Electrode Pairs
13 Dielectric Film
14 Protective Film
15 Needle Crystals
16 Catalyst Layer
20 Back Panel
21 Back Substrate
22 Data Electrodes
23 Dielectric Film
24 Barrier Ribs
25 Phosphor Film
30 Discharge Space

40 Needle Crystal Particles
100 PDP
121 Scan Electrodes
121 Display Electrodes
122 Sustain Electrodes
123 Electron Emitting Electrodes
141 Lower Layer of Protective Film
142 Upper Layer of Protective Film

BEST MODE FOR CARRYING OUT THE INVENTION

Preferred embodiments of the present invention are described below with reference to the drawings.

Embodiment 1

Figure 1:
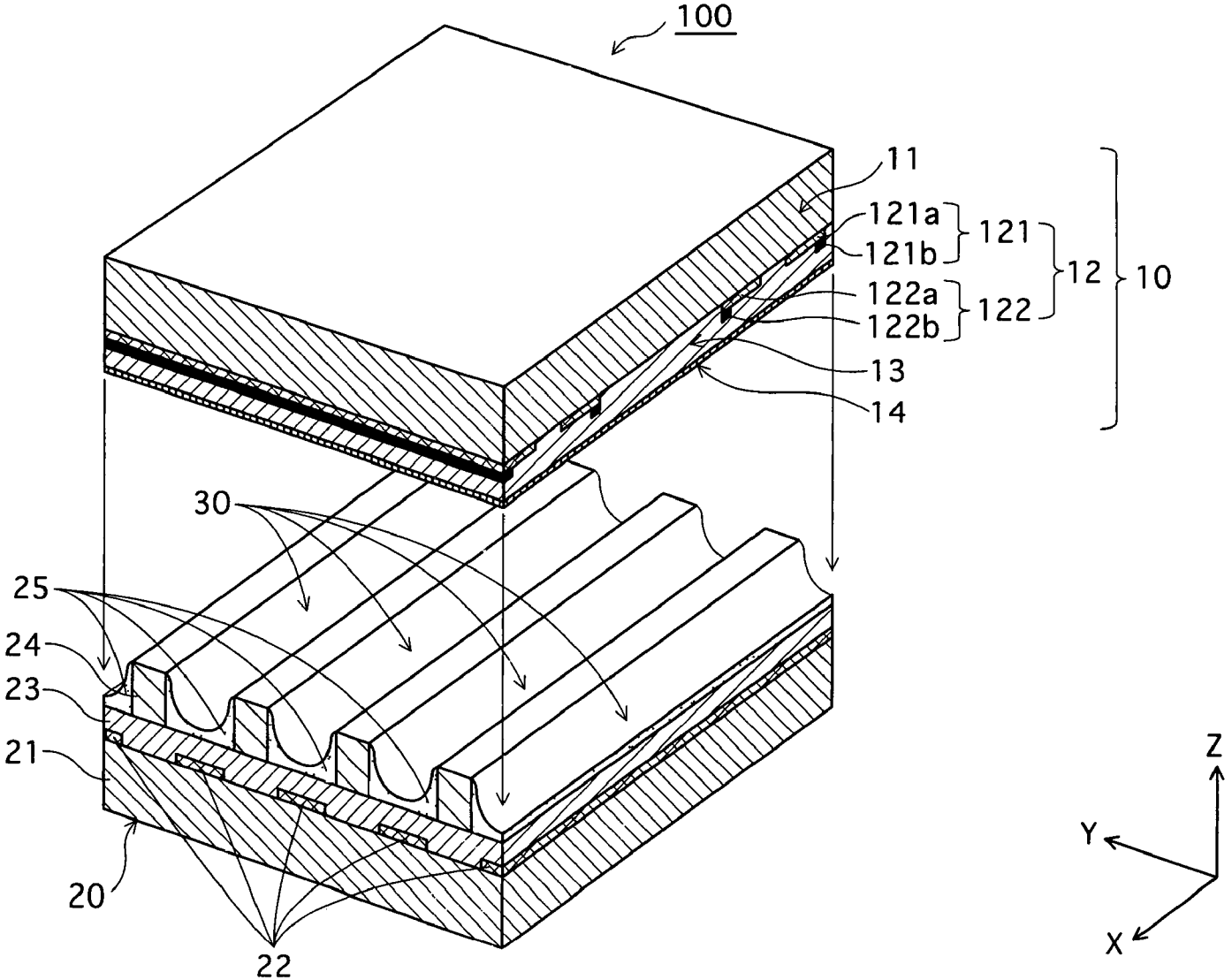
FIG. 1 is a perspective view showing a main section of the configuration of a PDP pertaining to preferred embodiments of the present invention.

FIG. 1 is a perspective view showing a main section of the configuration of a PDP pertaining to preferred embodiments of the present invention.

PDP 100 is constituted from a front panel and a back panel that are stuck together.

Front panel 10 is constituted from a plurality of display electrode pairs 12 (scan electrodes 121 and sustain electrodes 122) formed in stripes on one side of a front substrate 11 composed of glass plate, and a first dielectric film 13 and a protective film 14 layered to cover the electrodes.

On the other hand, back panel 20 is constituted from a plurality of data electrodes 22 formed in stripes on one side of a back substrate 21 composed of glass plate, a second dielectric film 23 layered to cover data electrodes 22, barrier ribs 24 formed on second dielectric film 23 between data electrodes 22, and phosphor film 25 applied to the surface of second dielectric film 23 and to the side walls of barrier ribs 24.

Front substrate 11 and back substrate 21 are disposed parallel to each other via barrier ribs 24 with a space between the panels, and discharge cells are formed where display electrode pairs 12 and data electrodes 22 intersect in three-dimensional space.

When driving this PDP, a write discharge is fired by applying voltages to scan electrodes 121 and data electrodes 22 in discharge cells to be turned on, to store wall charge, and a sustain pulse is then applied alternately to scan electrodes 121 and sustain electrodes 122. This results in a sustain discharge being selectively produced in discharge cells in which the write discharge was generated to thus emit light and display an image.

Scan electrodes 121 and sustain electrodes 122 are respectively constituted from narrow metal bus electrodes 121*b* and 122*b* layered on wide transparent electrodes 121*a* and 122*a* composed of metal oxides.

Dielectric glass, $SiO_2$ or the like is employed as the material for dielectric film 13.

Metal oxides such as MgO, CaO, SrO and BaO, or a compound of two or more types selected from these metal oxides (e.g. a compound of MgO and CaO) are employed as the material for protective film 14.

Configuration of Front Panel 10

Figure 2:
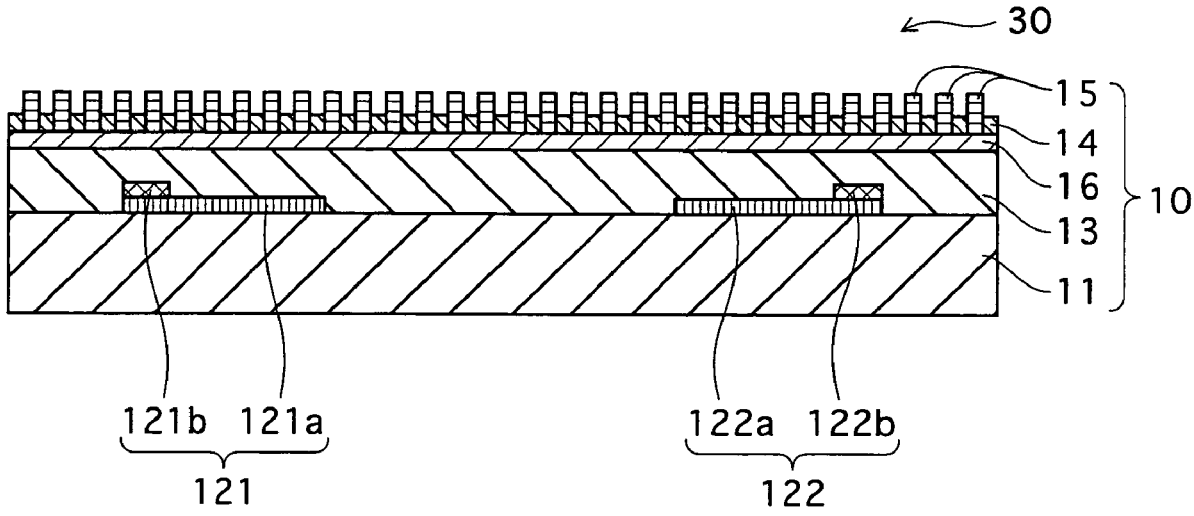
FIG. 2 shows a configuration of a front panel 10 pertaining to an embodiment 1.
Figure 4A:
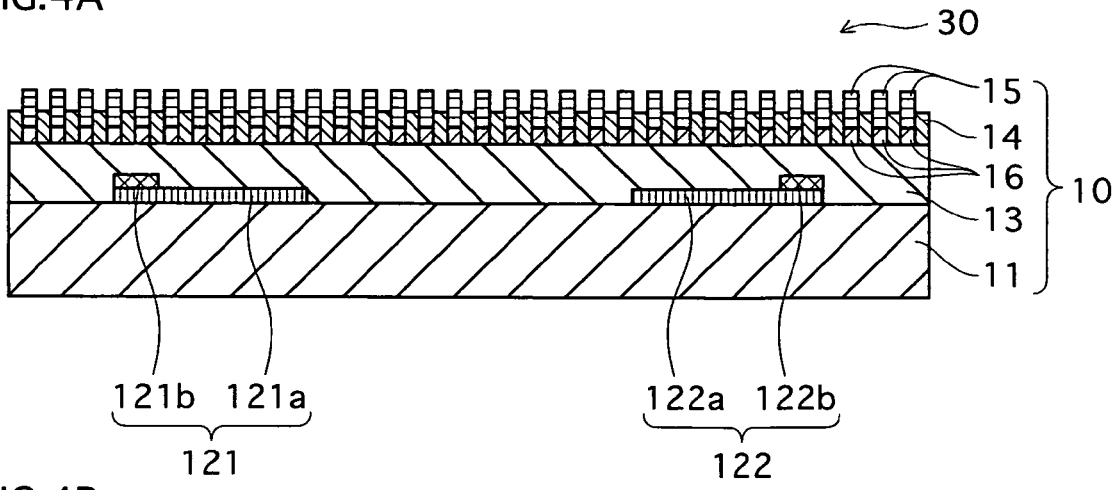
FIGS. 4A-4C show a configuration of front panel 10 pertaining to embodiment 1.
Figure 5:
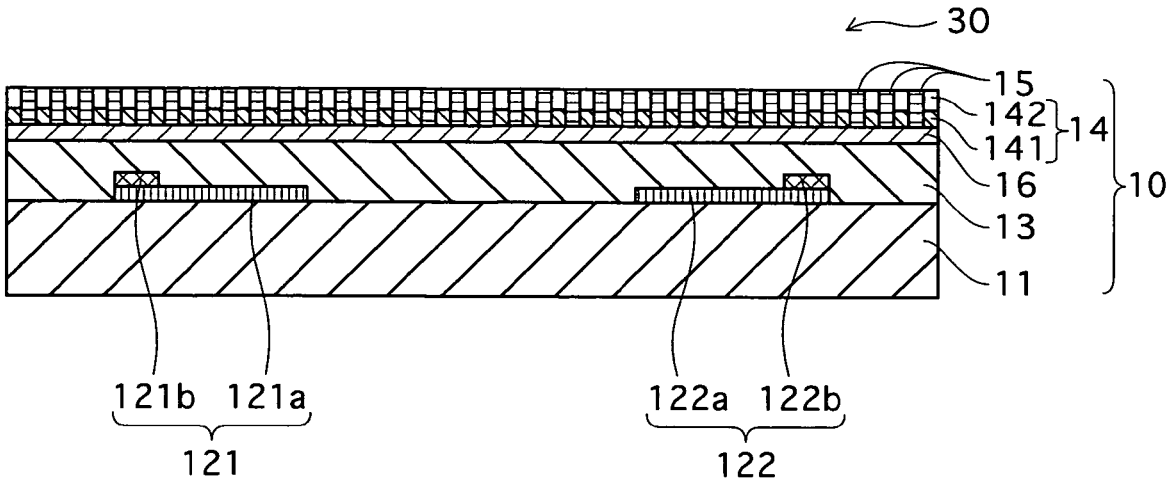
FIG. 5 shows a configuration of front panel 10 pertaining to embodiment 1.

FIGS. 2, 4A and 5 are cross-sectional schematic diagrams showing configurations of front panel 10 pertaining to the present embodiment.

The configurations of front panel 10 shown in FIGS. 2, 4A and 5, despite differing from each other in minor detail, all have needle crystals 15 that are disposed in an upright position on the surface of first dielectric film 13, and penetrate protective film 14 in a thickness direction. These needle crystals 15 are formed using a conductive substance or a semiconductor substance.

Furthermore, needle crystals 15, when viewed from above display electrodes 121 and 122, are dispersed on the surface of first dielectric film 13.

In other words, needle crystals 15 are scattered over first dielectric film 13, and the gaps between the crystals are filled with the protective film material. Furthermore, needle crystals 15 form a phase-separated structure with protective film 14.

Note that while needle crystals 15 are disposed over the entire surface of first dielectric film 13 in the example shown in FIGS. 2, 4A and 5, needle crystals 15 may be disposed only in positions corresponding to a central portion of the discharge cells.

Needle-like graphite particles preferably are employed as needle crystals 15. CNT, GNF and DLC are given as specific examples of needle-like graphite particles. There is both conductive CNT and semiconductor CNT, either of which is usable.

Figure 3:
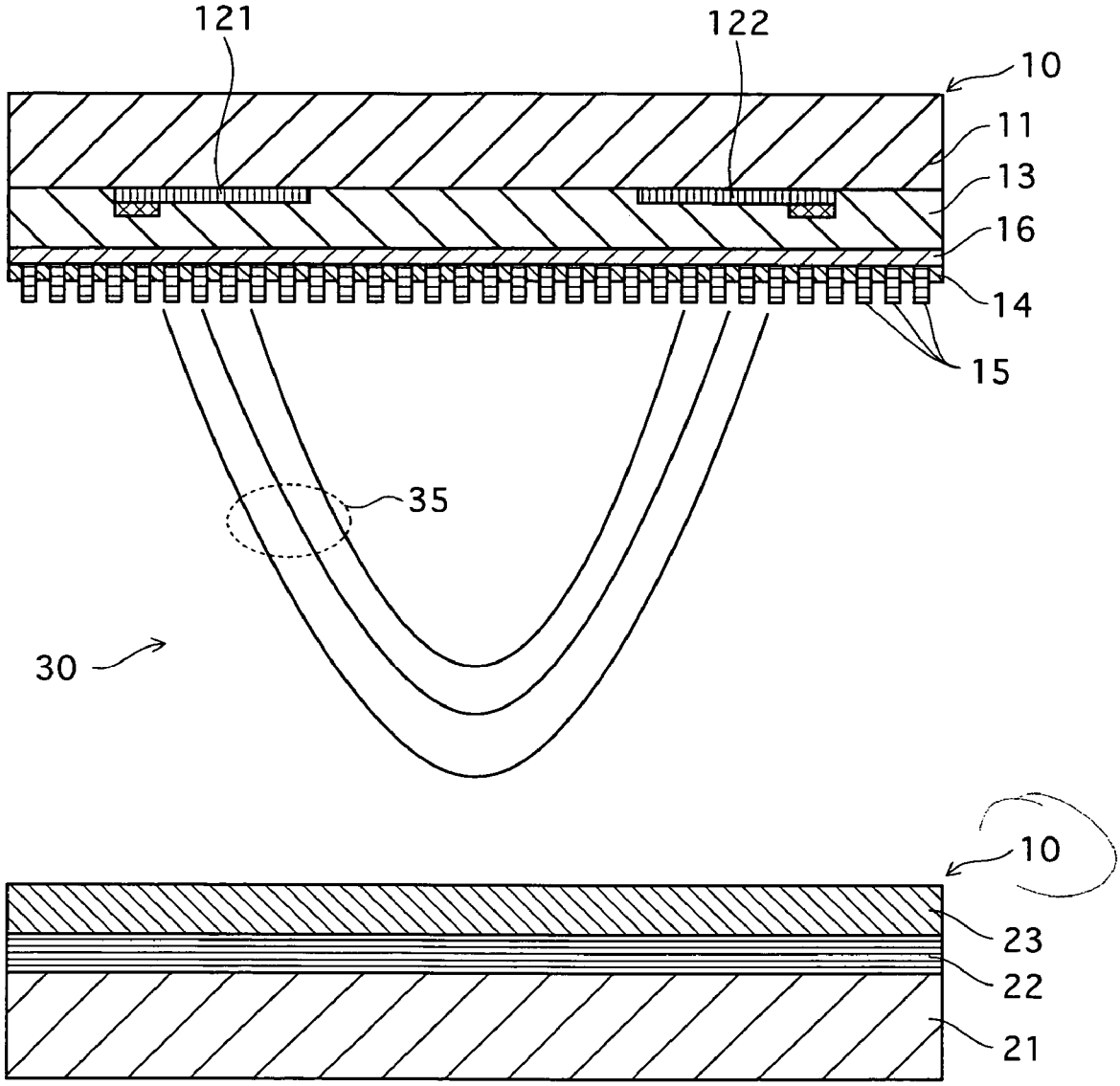
FIG. 3 shows the discharge pattern during a sustain discharge in a PDP pertaining to an embodiment 1.

A catalyst layer 16 is interposed between needle crystals 15 and first dielectric film 13, as shown in FIGS. 2 and 3. This catalyst layer 16 is a substance that forms the nucleus for growing the needle-like graphite particles during manufacture, with a metal such as Ni, Fe, or Co being used.

Figure 4B:
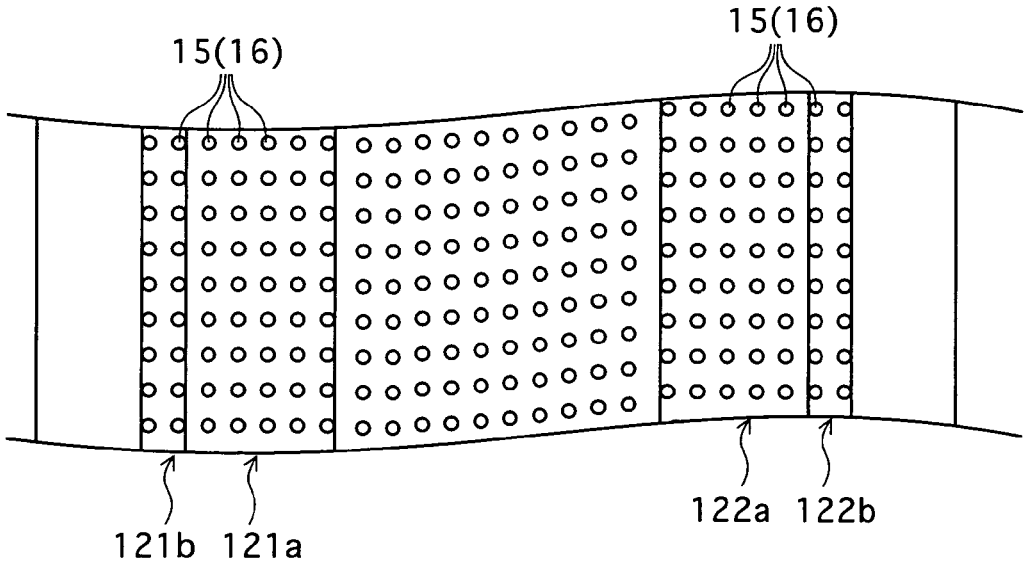
Figure 4C:
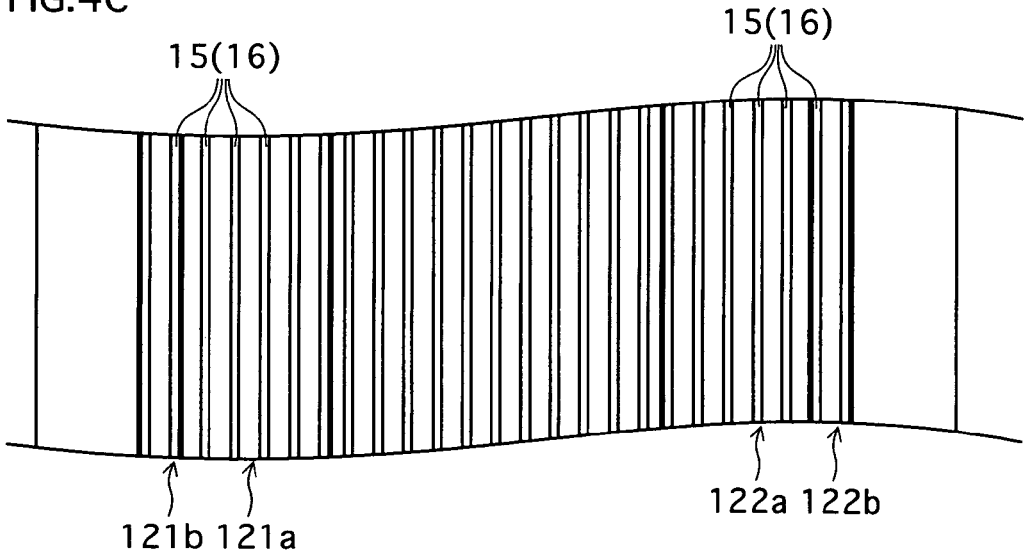

As for the configuration in which needle crystals 15 are scattered over first dielectric film 13, in the FIG. 2 example the needle crystals are scattered uniformly over first dielectric film 13, whereas in the FIGS. 4 and 5 examples areas on first dielectric film 13 with crystals are mixed with areas without crystals. Specifically, in FIG. 4B the areas with needle crystals 15 are dotted throughout the areas without needle crystals 15, and in FIG. 4C the areas with and without crystals 15 are formed in stripes.

Note that with the configurations of front panel 10 shown in FIGS. 2 and 4A, the tips of needle crystals 15 protrude into discharge space 30 above the surface of protective film 14, although the tips need not protrude into discharge space 30, provided they are in proximity to the surface of protective film 14.

Manufacture of Front Panel 10

The manufacturing method for the configurations of front panel 10 shown in FIGS. 2 and 4 is described firstly.

First dielectric film 13 is formed after scan electrodes 121 and sustain electrodes 122 have been formed on front substrate 11. First dielectric film 13 can be formed, for example, by depositing $SiO_2$ on front substrate 11 using sputtering or electron beam evaporation. Alternatively, a low-melting point glass material may be deposited to form the first dielectric film.

The material of catalyst layer 16 (a metal such as Ni, Fe, Co etc.) is formed on first dielectric film 13 using sputtering or electron beam evaporation.

With front panel 10 shown in FIG. 2, catalyst layer 16 is formed over the entire first dielectric film 13. In this case, catalyst layer 16 is actually made up of discontinuous island-like films as a result of forming the catalyst layer at a film thickness of 10 nm or less, and preferably 2-5 nm. In the case of front panel 10 shown in FIG. 4, on the other hand, catalyst layer 16 is patterned on first dielectric film 13.

The patterning may be performed using a mask with openings only in areas where catalyst layer 16 is to be formed, or by firstly forming the material of catalyst layer 16 in a layer over the entire first dielectric film 13, and then pattern etching areas other than those where catalyst layer 16 is to be formed to remove the material in those areas.

Next, in a vacuum process, graphite particles are grown in a needle shape on catalyst layer 16. The graphite particles are selectively grown only on catalyst layer 16, resulting in needle crystals 15 composed of graphite being formed vertically on catalyst layer 16.

For example, by growing the graphite particles at a substrate temperature of approximately 400° C. using plasma CVD that employs ethylene as the raw material gas, CNTs of 200 nm in thickness ϕ are formed in bundles, with the bundle thickness being approximately 1-5 μm.

Here, the density at which the CNTs are formed on catalyst layer 16 is adjusted by appropriately setting disposition conditions such as substrate temperature, disposition speed and base conditions, making it possible to form the CNTs to be moderately dispersed.

Consequently, even in the case where catalyst layer 16 is formed over the entire first dielectric film 13 as in FIG. 2, the CNTs can be moderately dispersed on catalyst layer 16, because the catalyst layer is actually formed in islands as noted above.

On the other hand, in the case where catalyst layer 16 is patterned as in FIGS. 4A to 4C, the size of the CNT bundles grown on first dielectric film 13 can be controlled through controlling the size and distribution of catalyst layer 16.

For example, in the case where catalyst layers 16 of ϕ 3 μm in size are dotted over first dielectric film 13, ϕ 200 nm CNTs are grown on each catalyst layer 16 in bundles of 30-60 CNTs.

Next, protective film 14 is formed over front substrate 11 on which needle crystals 15 have been formed. This protective film 14 can be formed using sputtering or electron beam evaporation to deposit MgO.

In this process, the protective film material is deposited on first dielectric film 13 in a form that allows the material to seep into the gaps between needle crystals 15.

Consequently, a phase-separated structure is formed with the vertically oriented needle crystals and the protective film material.

The manufacturing method of front panel 10 shown in FIG. 5 is described next.

First dielectric film 13 is formed after scan electrodes 121 and sustain electrodes 122 have been formed on front substrate 11. Catalyst layer 16 is formed over the entire first dielectric film 13, and MgO is deposited on catalyst layer 16 to form a lower layer 141 of the protective film over the entire catalyst layer 16.

Blind holes are then formed in lower layer 141 of the protective film using mask etching to a depth that exposes catalyst layer 16. The diameter ϕ of the blind holes is 5 μm, for example.

Next, in a vacuum process, graphite particles are grown in a needle shape on catalyst layer 16. The graphite particles are selectively grown only on catalyst layer 16 at the bottom of the blind holes, with hardly any growing on the surface of lower layer 141 of the protective film, resulting in needle crystals 15 composed of graphite particles growing perpendicular to front substrate 11.

MgO is then deposited on lower layer 141 of the protective film using sputtering or electron beam evaporation to form an upper layer 142 of the protective film. In this process, the material of upper layer 142 enters the gaps between the graphite particles in the blind holes, resulting a phase-separated structure being formed with the vertically oriented needle crystals 15 and the upper layer material.

Effects of Front Panel 10 in Embodiment 1

According to front panel 10 having the above configurations, protective film 14 works to lower the discharge voltage and reduce discharge variability by efficiently emitting secondary electrons in discharge space 30, as well as to protect first dielectric film 13 and display electrodes 121 and 122 from high energy ions produced by the discharges, similarly to a conventional protective film.

Furthermore, since needle crystals 15 stand substantially perpendicular to the surface of front substrate 11, secondary electrons are favorably emitted due to efficient ion and energy exchange and the absorption of primary electrons. This is described below with reference to FIG. 3.

FIG. 3 shows a discharge pattern (pattern of the discharge current) during the sustain discharge in a PDP provided with the above front panel 10.

A discharge pattern 35 is formed in an arc between needle crystals 15 over scan electrodes 121 and needle crystals 15 over sustain electrodes 122 during the sustain discharge, as shown in FIG. 3. Consequently, secondary electrons are efficiently emitted from the surface of protective film 14, because primary electrons and ions produced by the discharge are incident on the surface of protective film 14 at an angle close to the perpendicular. A high secondary electron emission coefficient is thus obtained.

Furthermore, in the case where the tips of needle crystals 15 are exposed in discharge space 30, the primary electrons and ions collide efficiently with the exposed portions, and, moreover, the resultant secondary electrons collide in the gaps between needle crystals 15, emitting large amounts of secondary electrons in a chain reaction.

A high electron emission coefficient is obtained particularly in the case where needle crystals 15 are graphite particles such as CNT or DLC.

As described above, according to front panel 10 pertaining to the present embodiment, unevenness need not be formed on the surface of protective film 14 because of the reduction in discharge firing voltage resulting from the increase in secondary electron emission obtained through the action of needle crystals 15. In short, the effects are obtained even when protective film 14 is thickly formed.

Therefore, by securing the thickness of protective film 14 and eliminating patchiness in the formation of protective film 14, variability in secondary electron emission performance can also be suppressed and uniform display quality made possible.

In this way, according to a PDP using front panel 10 pertaining to the present embodiment, the discharge firing voltage can be reduced, while ensuring the wall-charge holding performance, as well as suppressing discharge variability.

Furthermore, needle crystals 15 are stable against mechanical change and temperature change because of being mechanically supported by protective film 14 present around the crystals.

Note that while the electron emissivity is higher when the tips of needle crystals 15 protrude above the surface of protective film 14, the durability of protective film 14 is superior when the tips of needle crystals 15 do not protrude above the surface of protective film 14, as is mechanical stability and stability against temperature change.

Note also that with the present embodiment, the emission efficiency of secondary electrons is sufficiently high, because the needle crystals, which are typically CNTs as described above, extend in a thickness direction. If, however, the CNTs were oriented parallel to the surface of the dielectric film, or if the CNTs were oriented in a disorderly fashion, primary electrons produced by the discharge would pass through the thin CNT layer and the emission efficiency of secondary electrons would be insufficiently high, causing variability in the discharge firing voltage. Furthermore, in this case, the CNT film, which is typically porous, would be unstable against mechanical and temperature changes because of the lack of reinforcing material.

Formation Density of Needle Crystals 15

The percentage of the total surface area of first dielectric film 13 occupied by needle crystals 15 (formation density of needle crystals 15) is considered next.

The discharge firing voltage decreases even when needle crystals 15 are formed at low density, although since the reduction in the discharge firing voltage increases as the formation density of needle crystals 15 increases, the needle crystals preferably are formed at a density of at least 30% in order to sufficiently obtain the effects of the present invention.

On the other hand, since the wall-charge holding performance of the surface of protective film 14 decreases when the formation density of needle crystals 15 is too high, the needle crystals preferably are formed at a density of no more than 90%.

Furthermore, since the difference in discharge firing voltage is not significant at formation densities in excess of 60%, needle crystals 15 preferably are formed at a density of 60% or less.

Embodiment 2

The overall PDP configuration is similar to embodiment 1.

Figure 6:
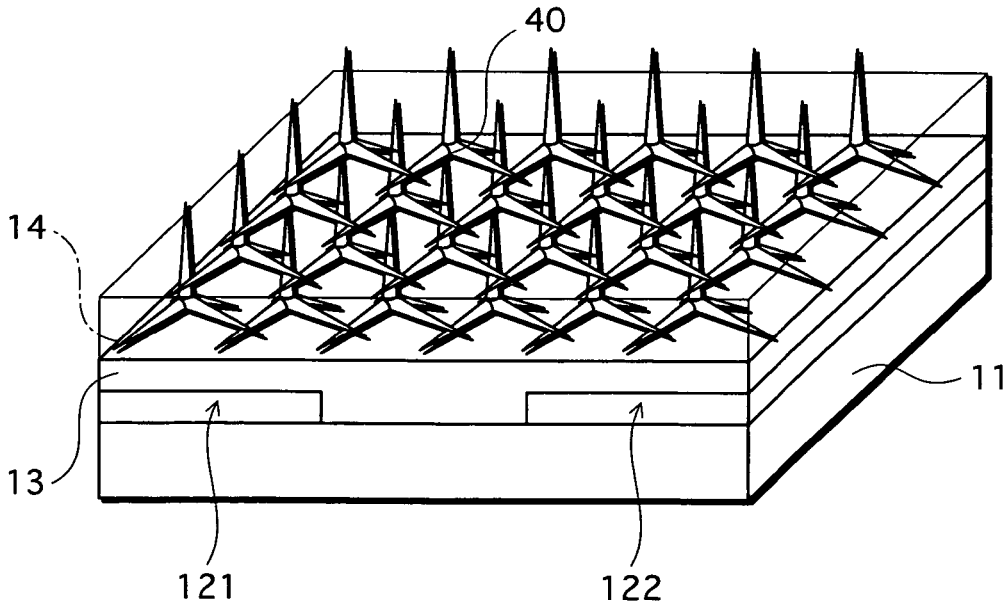
FIG. 6 shows a configuration of front panel 10 pertaining to an embodiment 2.

FIG. 6 is a perspective view of a main section of front panel 10 in embodiment 2.

This front panel 10 is constituted from a plurality of display electrode pairs 12 formed in stripes on one side of a front substrate 11 composed of glass plate, and a first dielectric film 13 and a protective film 14 layered to cover these electrode pairs. Tetrapod-shaped needle crystal particles 40 are disposed on the surface of first dielectric film 13, and penetrate protective film 14. Needle crystal particles 40 are formed using a conductive substance or a semiconductor substance.

Needle crystal particles 40 disposed on the surface of first dielectric film 13 each have four arms owing to their tetrapod shape. Three of these arms contact the surface of first dielectric film 13, while the fourth arm stands perpendicular to the surface of first dielectric film 13. Consequently, the needle crystals stand upright on the surface of first dielectric film 13.

Furthermore, needle crystal particles 40, when viewed from above first dielectric film 13, are dispersed on the surface of first dielectric film 13.

In other words, needle crystal particles 40 are scattered over first dielectric film 13, and gaps between the particles are filled with the protective film material. Furthermore, needle crystal particles 40 form a phase-separated structure with protective film 14.

As a specific example of needle crystal particles 40, tetrapod-shaped ZnO particles can be used.

Tetrapod-shaped ZnO particles are produced by causing a thermochemical reaction using an organometallic compound as the raw material, and have semiconductor properties. Zinc oxide whiskers marketed by Matsushita Electric Industrial Co., Ltd. under the trade name "Panatetra" are commercially available at an arm length of approximately 15 μm and an arm thickness of approximately 500 nm, for example.

Note that the apex of the arms of needle crystal particles 40 may or may not protrude above the surface of protective film 14.

Similar effects to embodiment 1 are achieved by using front panel 10 of the present invention.

That is, the secondary electron emission coefficient of protective film 14 increases, because the arms of needle crystal particles 40 stand substantially perpendicular to the surface of front substrate 11. Furthermore, needle crystal particles 40 are stable against mechanical change and temperature change because of being mechanically supported by protective film 14 present around the particles.

The manufacturing method of front panel 10 of the present embodiment is described next.

First dielectric film 13 is formed after scan electrodes 121 and sustain electrodes 122 have been formed on front substrate 11.

A coating material is prepared in which tetrapod-shaped needle crystal particles 40 are dispersed in an alcohol solvent. Needle crystal particles 40 preferably make up 30% to 90% of the coating material, and more preferably 60% or less.

Note that forming protective film 14 sequentially after needle crystal particles 40 have been dispersed as described above is preferable in terms of ease of manufacture. However, it is also conceivable in the present embodiment to firstly form the lower layer of the protective film with concavities formed where needle crystal particles 40 will be positioned, and then to form the upper layer of the protective film after disposing needle crystal particles 40 in the concavities.

Embodiment 3

The overall PDP configuration is similar to embodiment 1.

FIGS. 7 and 8 show configurations of front panel 10 pertaining to the present embodiment.

Figure 7A:
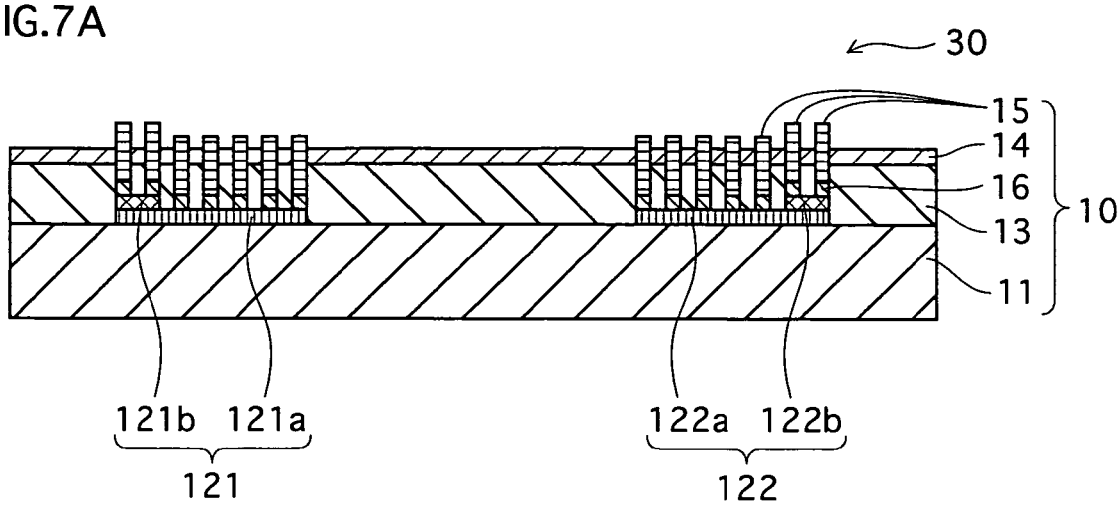
FIGS. 7A-7C show a configuration of front panel 10 pertaining to embodiment 3.
Figure 7B:
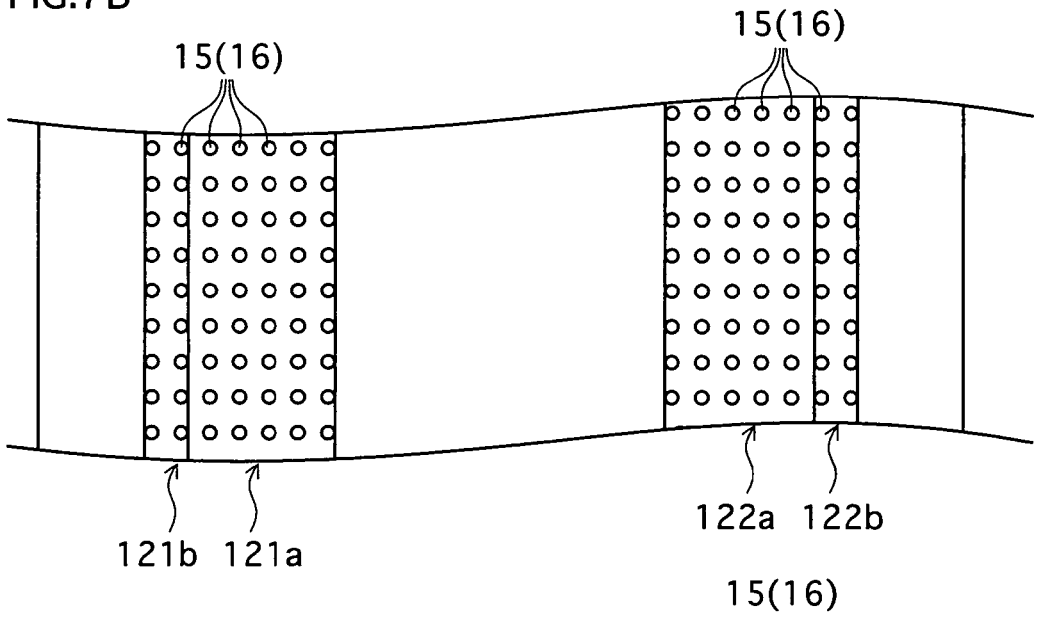
Figure 7C:
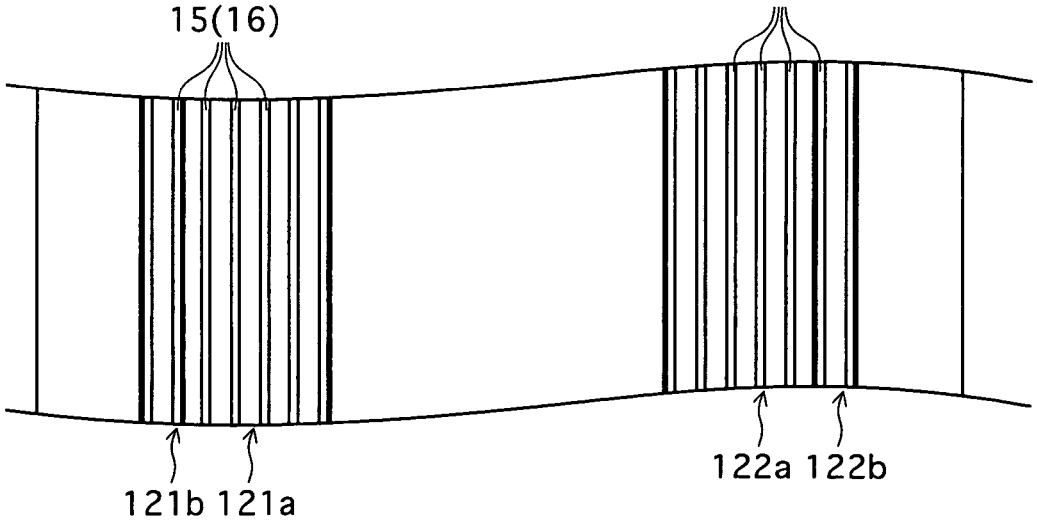
Figure 8A:
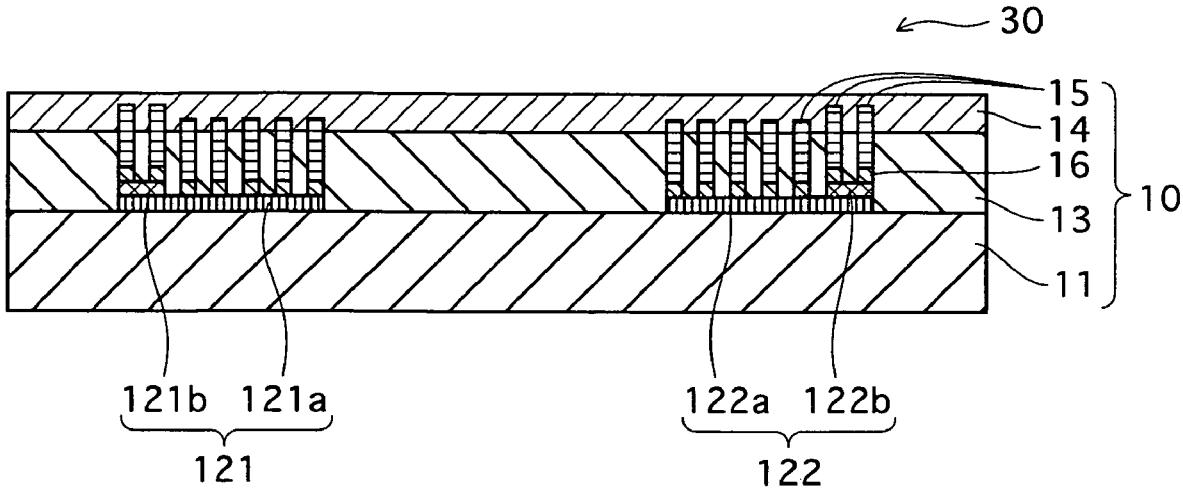
FIGS. 8A-8B show a configuration of front panel 10 pertaining to embodiment 3.
Figure 8B:
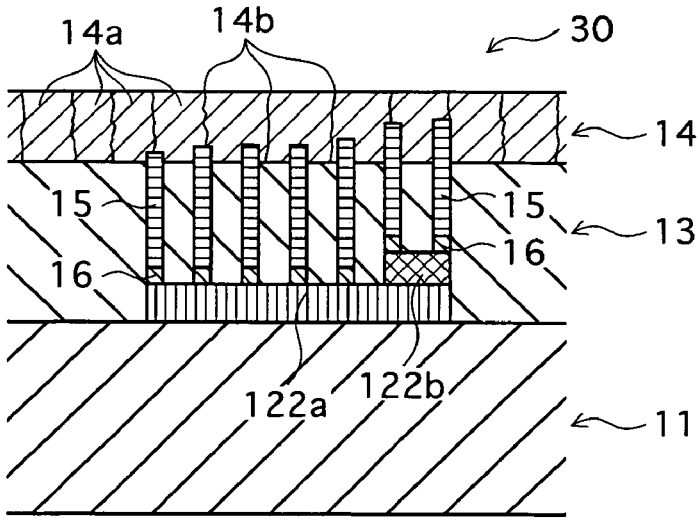

FIGS. 7A and 8A are schematic cross-sectional views of front panel 10, while FIGS. 7B and 7C are schematic plan views of front panel 10. FIG. 8B is a partially enlarged view of FIG. 8A.

Needle crystals 15 are disposed in an upright position on the surface of display electrodes 121 and 122, and penetrate first dielectric film 13, as shown in FIGS. 7A and 8A. Needle crystals 15 are formed using a conductive substance or a semiconductor substance. With front panel 10 shown in FIGS. 7A to 7C, the tips of needle crystals 15 are exposed in the discharge space above the surface of protective film 14, whereas in FIGS. 8A to 8B the tips of needle crystals 15 remain within protective film 14 and are not exposed in the discharge space. The crystals are otherwise similar.

Furthermore, needle crystals 15, when viewed from above display electrodes 121 and 122, are dispersed on the surface of display electrodes 121 and 122, as shown in FIGS. 7B and 7C.

In other words, needle crystals 15 are scattered over display electrodes 121 and 122, and gaps between the crystals are filled with the materials of first dielectric film 13 and protective film 14. Furthermore, needle crystals 15 form a phase-separated structure with dielectric film 13 and protective film 14.

Note that while needle crystals 15 are dotted over the surface in FIG. 7B and formed in stripes in FIG. 7C, needle crystals 15 in both cases are scattered over display electrodes 121 and 122.

In the examples shown in FIGS. 7B and 7C, needle crystals 15 are disposed over the entire surface of display electrodes 121 and 122, although it is possible to dispose needle crystals 15 only in positions corresponding to a central portion of the discharge cells.

Needle-like graphite particles preferably are employed as needle crystals 15. CNT, GNF and DLC are given as specific examples of needle-like graphite particles. There is both conductive CNT and semiconductor CNT, either of which is usable.

A catalyst layer 16 is interposed between needle crystals 15 and display electrodes 121 and 122, as shown in FIGS. 7 and 8. As described in embodiment 1, catalyst layer 16 is a substance that forms the nucleus for growing the needle-like graphite particles during manufacture, with a metal such as Ni, Fe or Co being used.

Effects of Front Panel 10 of Embodiment 3

According to front panel 10 having the above configuration, protective film 14 works to decrease the discharge voltage by efficiently emitting secondary electrons in discharge space 30, as well as to protect first dielectric film 13 and display electrodes 121 and 122 from ions produced by the discharges, similarly to a conventional protective film.

Furthermore, since needle crystals 15 composed of a conductive substance or a semiconductor substance are disposed on the surface of display electrodes 121 and 122 to penetrate first dielectric film 13 in a thickness direction, electrons are supplied to discharge space 30 from display electrodes 121 and 122 via needle crystals 15 following the application of a voltage between display electrodes 121 and 122 when the PDP is driven.

Here, in the case where the tips of needle crystals 15 are exposed in discharge space 30 above the surface of protective film 14 as in FIG. 7A, electrons are supplied directly to discharge space 30 from the tips of needle crystals 15. However, even in the case where the tips of needle crystals 15 are not exposed in discharge space 30 but buried in protective film 14 as shown in FIG. 8B, cracks 14*b* form in protective film 14, which is generally composed of MgO, between columnar MgO crystals 14*a* constituting protective film 14, allowing electrons to be supplied from the tips of needle crystals 15 to discharge space 30 through these cracks 14*b*. Furthermore, this effect may also occur when electrons are injected into the conduction band of the MgO crystals.

Consequently, in the case of both FIGS. 7 and 8, the discharge firing voltage falls, because electrons are supplied to discharge space 30 via needle crystals 15 when a voltage is applied between display electrodes 121 and 122.

On the other hand, since the insulativity of display electrodes 121 and 122 from protective film 14 is secured in areas of dielectric film 13 other than those penetrated by needle crystals 15, the wall-charge holding performance of the surface of protective film 14 over these areas is ensured.

Furthermore, since needle crystals 15 stand substantially perpendicular to the surface of front substrate 11, secondary electrons are favorably emitted due to efficient ion and energy exchange and the absorption of primary electrons.

Figure 9:
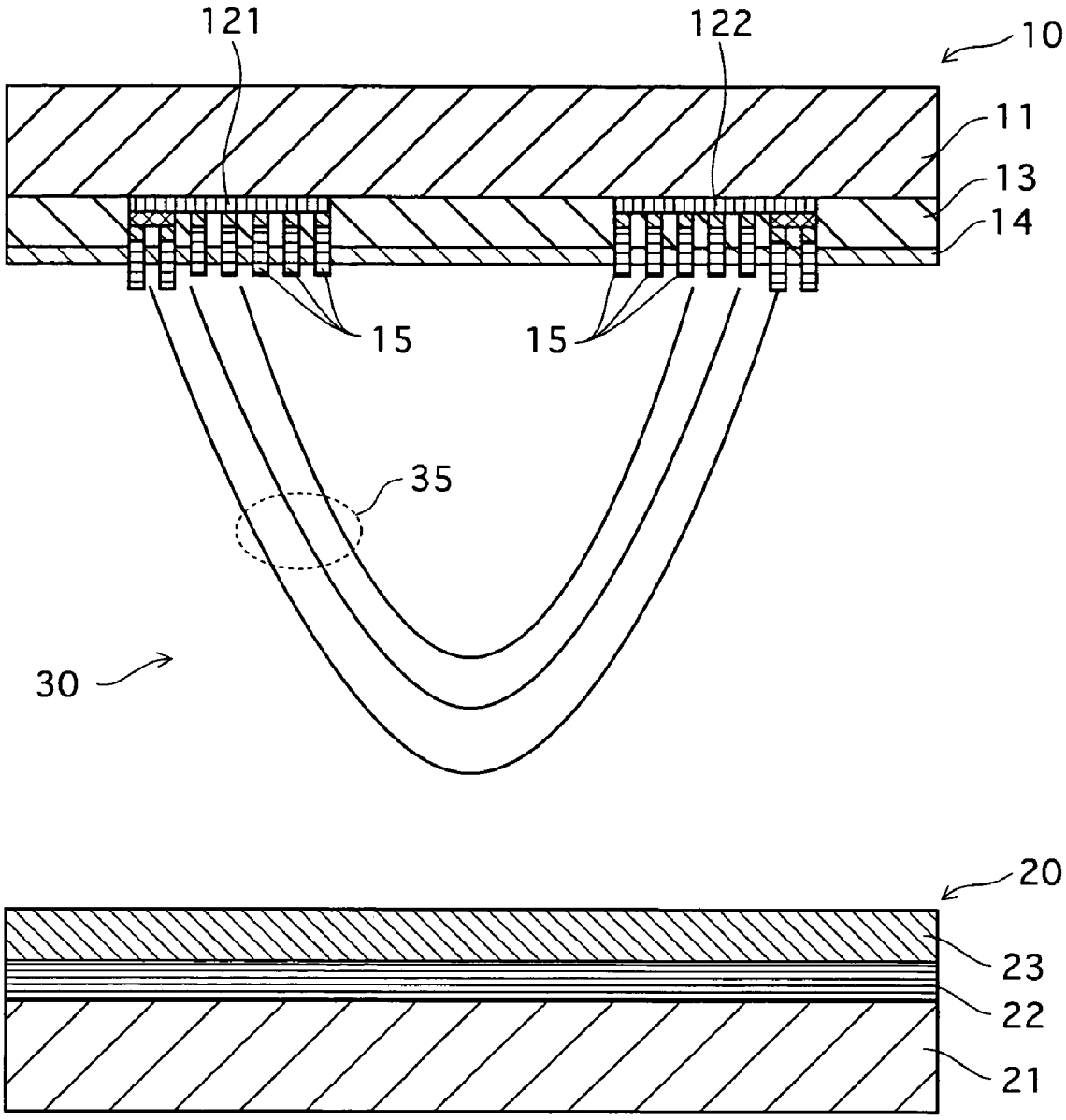
FIG. 9 shows the discharge pattern during a sustain discharge in a PDP pertaining to embodiment 3.

FIG. 9 shows a discharge pattern during the sustain discharge (pattern of discharge current). Similarly to FIG. 3 above, a discharge pattern 35 is formed in an arc between needle crystals 15 over scan electrodes 121 and needle crystals 15 over sustain electrodes 122 during the sustain discharge. Consequently, secondary electrons are efficiently emitted from the surface of protective film 14, because primary electrons and ions produced by the discharge are incident on the surface of protective film 14 at an angle close to the perpendicular. A high secondary electron emission coefficient is thus obtained.

Furthermore, in the case where the tips of needle crystals 15 are exposed in discharge space 30, the primary electrons and ions collide efficiently with the exposed portions, and, moreover, the resultant secondary electrons collide in the gaps between needle crystals 15, emitting large amounts of secondary electrons in a chain reaction.

A high electron emission coefficient is obtained particularly in the case where needle crystals 15 are graphite particles such as CNT or DLC.

According to front panel 10 pertaining to the present embodiment, unevenness need not be formed on the surface of protective film 14 because of the increase in secondary electron emission and the reduction in discharge firing voltage obtained through the action of needle crystals 15. In short, the effects are obtained even when protective film 14 is thickly formed.

Therefore, by securing the thickness of protective film 14 and eliminating patchiness in the formation of protective film 14, variability in secondary electron emission performance can also be suppressed and uniform display quality made possible.

In this way, according to a PDP using front panel 10 pertaining to the present embodiment, the discharge firing voltage can be reduced, while ensuring the wall-charge holding performance, as well as suppressing discharge variability.

Furthermore, needle crystals 15 are stable against mechanical and temperature change because of being mechanically supported by dielectric film 13 and protective film 14 present around the crystals.

Comparing the configurations in FIGS. 7 and 8, the electron emissivity of the FIG. 7 configuration is higher, whereas the durability of protective film 14 is superior with the FIG. 8 configuration, as is mechanical stability and stability against temperature change, because needle crystals 15 are not exposed in discharge space 30.

Formation Density of Needle Crystals on Display Electrodes

The percentage of the total surface area of display electrodes 121 and 122 occupied by needle crystals 15 (formation density of needle crystals 15) is considered next.

The discharge firing voltage decreases even when needle crystals 15 are formed at low density, although since the reduction in the discharge firing voltage increases as the formation density of needle crystals 15 increases, the crystals preferably are formed at a density of at least 30% in order to sufficiently obtain the effects of the present invention.

On the other hand, since the wall-charge holding performance of the surface of protective film 14 decreases when the formation density of needle crystals 15 is too high, the crystals preferably are formed at a density of no more than 90%.

Furthermore, since the difference in discharge firing voltage is not significant at formation densities in excess of 60%, needle crystals 15 preferably are formed at a density of 60% or less.

Manufacture of Front Panel 10 in Embodiment 3

After scan electrodes 121 and sustain electrodes 122 have been formed on front substrate 11, the material of catalyst layer 16 (a metal such as Ni, Fe, Co) is patterned on scan electrodes 121 and sustain electrodes 122 using sputtering or electron beam evaporation, as shown in FIG. 7B or 7C, to form catalyst layer 16.

Next, in a vacuum process, graphite particles are grown in a needle shape on catalyst layer 16. The graphite particles are selectively grown only on catalyst layer 16, resulting in needle crystals 15 composed of graphite being formed.

Here, adjusting the distribution density at which catalyst layer 16 on the surface of display electrodes 121 and 122 is formed by appropriately setting disposition conditions such as substrate temperature, disposition speed and base conditions, also enables the formation density of needle crystals 15 to be adjusted.

Dielectric film 13 is then formed on front substrate 11 having needle crystals 15 formed thereon, and protective film 14 is formed on dielectric film 13.

Dielectric film 13 can be formed, for example, by depositing $SiO_2$ using sputtering or electron beam evaporation. Alternatively, a low-melting point glass material may be deposited.

Protective film 14 can be formed using sputtering or electron beam evaporation to deposit MgO.

In this process, the materials of dielectric film 13 and protective film 14 are deposited over display electrodes 121 and 122 in a form that allows the materials to seep into the gaps between needle crystals 15.

Consequently, a phase-separated structure is formed with vertically oriented needle crystals 15 and the materials of dielectric film 13 and protective film 14.

As above, forming dielectric film 13 and protective film 14 sequentially after needle crystals 15 have been dispersed is preferable in terms of ease of manufacture. However, similarly to the manufacturing method of front panel 10 shown in FIG. 5, it is conceivable to firstly form dielectric film 13 on front substrate 11 to completely cover display electrodes 121 and 122, and to form blind holes above display electrodes 121 and 122. Protective film 14 is then formed after disposing needle crystals 15 in the blind holes.

Regarding High Xe Density in Discharge Gas

In a PDP, luminous efficiency generally rises with higher Xe density in the discharge gas, although the discharge firing voltage increases. To counter this, the discharge firing voltage can be kept low even at high Xe densities, by forming a phase-separated structure over the display electrodes with the crystals and the dielectric and protective films.

Consequently, in a PDP provided with a phase-separated structure as described above, high luminous efficiency is obtained while keeping the discharge firing voltage low, by setting the Xe density to a high value. As a result, it is possible to greatly reduce power consumption in the PDP.

For example, in a PDP having a conventional configuration without needle crystals disposed on the electrodes, the discharge firing voltage was measured at 180 V when 5% Xe+95% Ne was employed as the discharge gas, but increased to 220 V when 10% Xe+90% Ne was employed as the discharge gas.

In contrast, in a panel with a phase-separated structure formed using needle crystals, the discharge firing voltage was kept low at 180 V, even when 10% Xe+90% Ne was employed as the discharge gas.

Variations

With the above PDP 100, needle crystals 15 are disposed on the electrode surface of both display electrodes 121 and 122, although needle crystals 15 may be disposed on only one of display electrodes 121 and 122, which much simplifies the panel structure.

Figure 10:
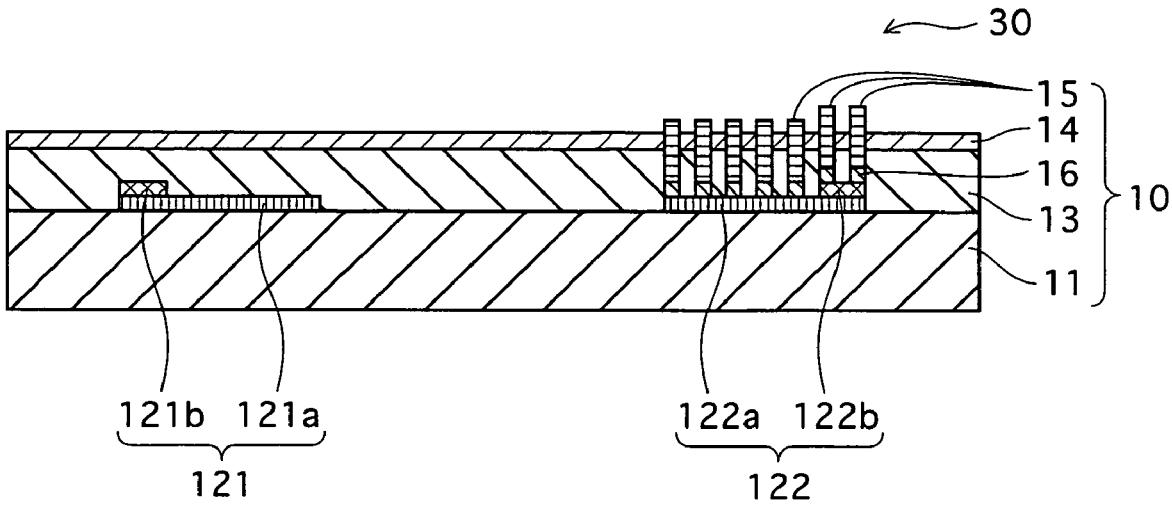
FIG. 10 shows a configuration of front panel 10 pertaining to a variation of embodiment 3.

For example, with a panel 10 shown in FIG. 10, needle crystals 15 are vertically oriented on the surface of sustain electrodes 122, and form a phase-separated structure with first dielectric film 13 and protective film 14, whereas needle crystals 15 are not present on the surface of scan electrodes 121.

Thus, by disposing needle crystals 15 on only display electrodes 121 or 122 to form a phase-separated structure, substantially similar results are obtained regarding the discharge firing voltage, compared to when needle crystals 15 are disposed on both display electrodes 121 and 122, despite the bias evident in the discharge pattern during the sustain discharge.

Embodiment 4

The overall PDP configuration is similar to embodiment 1.

Figure 11:
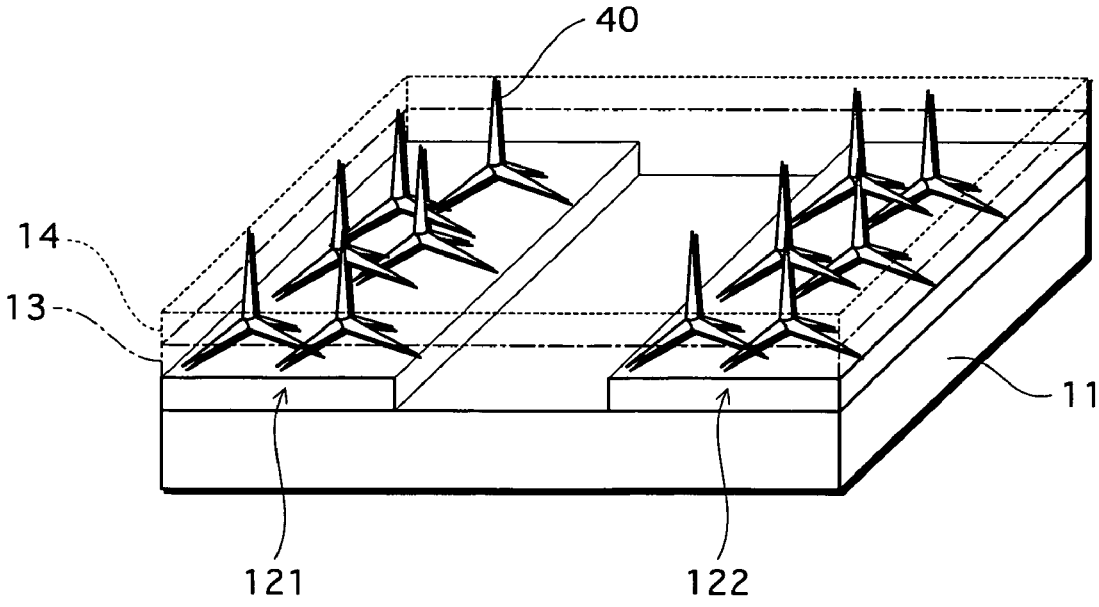
FIG. 11 is a perspective view of a main section of front panel 10 pertaining to an embodiment 4.

FIG. 11 is a perspective view of a main section of front panel 10 in embodiment 4.

This front panel 10 is constituted from a plurality of display electrode pairs 12 formed in stripes on one side of a front substrate 11 composed of glass plate, and a first dielectric film 13 and a protective film 14 layered to cover these electrode pairs. Tetrapod-shaped needle crystal particles 40 are disposed on the surface of display electrodes 121 and 122, and penetrate dielectric film 13. Needle crystal particles 40 are formed using a conductive substance or a semiconductor substance.

Needle crystal particles 40 disposed on the surface of display electrodes 121 and 122 each have four arms owing to their tetrapod shape. Three of these arms contact the surface of display electrodes 121 and 122, while the fourth arm stands perpendicular to the electrode surface. Consequently, needle crystals stand upright on the surface of display electrodes 121 and 122.

Furthermore, needle crystal particles 40, when viewed from above display electrodes 121 and 122, are dispersed on the surface of display electrodes 121 and 122.

In other words, needle crystal particles 40 are scattered over display electrodes 121 and 122, and the gaps between the particles are filled with the materials of dielectric film 13 and protective film 14. Furthermore, needle crystal particles 40 form a phase-separated structure with dielectric film 13 and protective film 14.

As a specific example of needle crystal particles 40, the tetrapod-shaped ZnO particles mentioned in embodiment 2 can be used.

Note that the apex of the arms of needle crystal particles 40 may be exposed above the surface of protective film 14, or may be buried below the surface of protective film 14.

Similar effects to embodiment 3 are achieved by using front panel 10 of the present embodiment.

That is, the discharge firing voltage drops, because electrons are supplied to discharge space 30 via needle crystal particles 40 when a voltage is applied between display electrodes 121 and 122. On the other hand, the wall-charge holding performance of the surface of protective film 14 is ensured in areas other than those over where needle crystal particles 40 penetrate dielectric film 13. Furthermore, the secondary electron emission coefficient increases, because the arms of needle crystal particles 40 stand substantially perpendicular to the surface of front substrate 11. Moreover, needle crystal particles 40 are stable against mechanical change and temperature change because of being mechanically supported by dielectric film 13 and protective film 14 present around the particles.

The manufacturing method of front panel 10 of the present embodiment is described next.

Scan electrodes 121 and sustain electrodes 122 are formed on front substrate 11.

A coating material is prepared in which tetrapod-shaped needle crystal particles 40 are dispersed in an alcohol solvent. The coating material is applied to scan electrodes 121 and sustain electrodes 122, and dried to remove the solvent. Needle crystal particles 40 are dispersed on scan electrodes 121 and sustain electrodes 122 as a result of this process, and adhered to scan electrodes 121 and sustain electrodes 122 by Van Der Waals force or electrostatic force.

Here, the density at which needle crystal particles 40 are distributed on scan electrodes 121 and sustain electrodes 122 can be adjusted by adjusting the amount of needle crystal particles 40 contained in the coating material.

First dielectric film 13 and protective film 14 are formed sequentially to cover scan electrodes 121 and sustain electrodes 122 on the panel surface on which needle crystal particles 40 have been applied.

Dielectric film 13 can be formed by using sputtering or electron beam evaporation to deposit $SiO_2$, or by depositing a low-melting point glass material, and protective film 14 can be formed by using sputtering or electron beam evaporation to deposit MgO. As a result of this process, the materials of dielectric film 13 and protective film 14 are sequentially deposited in layers on display electrodes 121 and 122, having seeped between the arms of needle crystal particles 40 and between the particles themselves. Consequently, the arms of needle crystal particles 40 form a phase-separated structure with the materials of dielectric film 13 and protective film 14.

Note that since hardly any of the dielectric film or protective film material is deposited on the apex of the arms of needle crystal particles 40, the arms remain exposed above the surface of protective film 14 until the thickness of dielectric film 13 and protective film 14 reaches the height of the apex of the arms, but that needle crystal particles 40 are buried in dielectric film 13 and protective film 14 when the thickness of the films increases.

Here, by adjusting the amount of needle crystal particles 40 contained in the coating material, the density at which needle crystal particles 40 are distributed on first dielectric film 13 can be adjusted.

Protective film 14 is formed using sputtering or electron beam evaporation to deposit MgO on the surface on which needle crystal particles 40 have been applied. This process results in the protective film material seeping between both the arms of needle crystal particles 40 and the particles themselves on first dielectric film 13. Consequently, a phase-separated structure is formed with the arms of the vertically oriented needle crystal particles and the protective film material.

Note that since hardly any of the protective film material is deposited on the apex of the arms of needle crystal particles 40, the arms remain exposed above the surface of protective film 14 until the thickness of dielectric film 13 reaches the height of the apex of the arms, but that needle crystal particles 40 are buried in protective film 14 when the thickness of the film increases.

The disposition density of needle crystal particles 40 on the surface of display electrodes 121 and 122 preferably is 30% to 90%, and more preferably 60% or less, similarly to that described in embodiment 3.

Forming dielectric film 13 and protective film 14 sequentially after needle crystal particles 40 have been dispersed as described above is preferable in terms of ease of manufacture. However, it is also conceivable in the present embodiment to firstly form dielectric film 13 with concavities formed where needle crystal particles 40 will be positioned, and then to form protective film 14 after disposing needle crystal particles 40 in the concavities.

Embodiment 5

The overall PDP configuration is similar to embodiment 1.

Figure 12A:
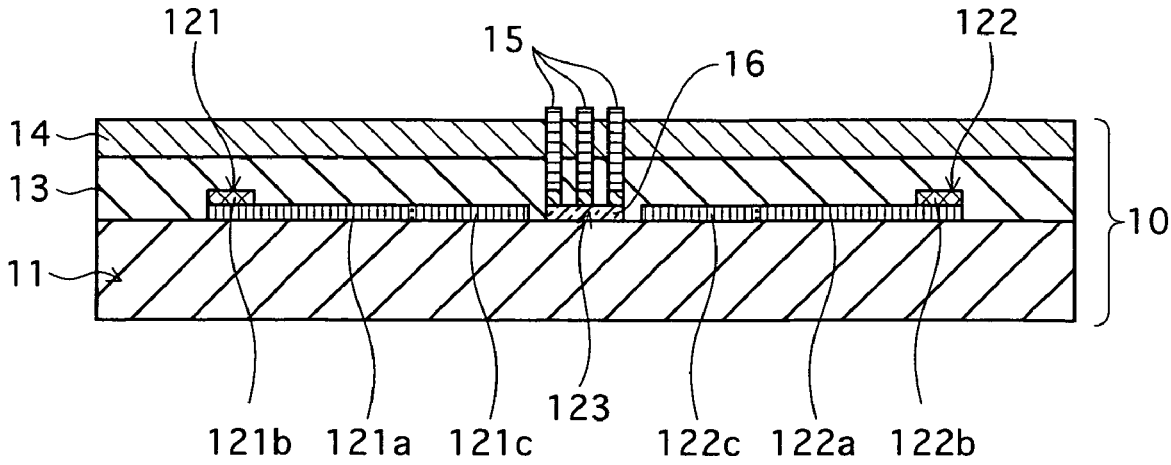
FIGS. 12A-12B show a configuration of front panel 10 pertaining to an embodiment 5.
Figure 12B:
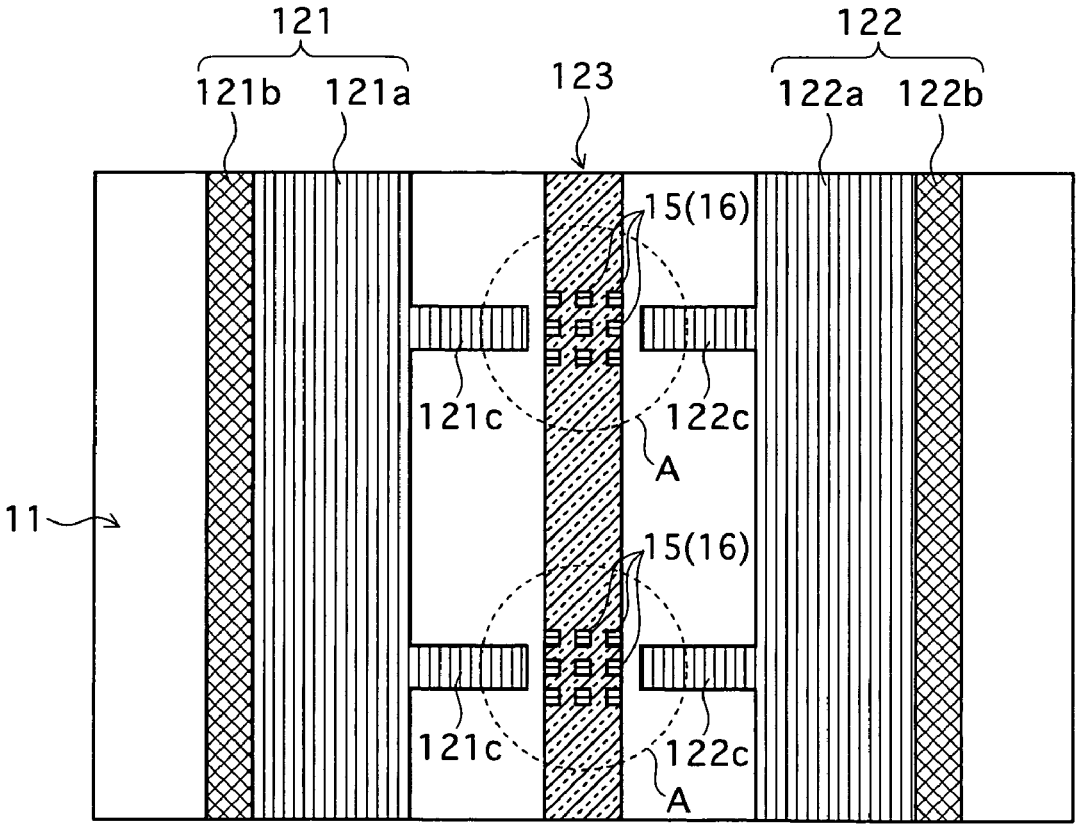

FIGS. 12A and 12B are cross-sectional and plan views of a main section of the configuration of front panel 10 pertaining to an embodiment 5.

Similarly to embodiment 3, this front panel 10 is constituted from a plurality of display electrode pairs 12 (scan electrodes 121 and sustain electrodes 122) formed in stripes on one side of a front substrate 11, and a first dielectric film 13 and a protective film 14 layered to cover these electrode pairs.

However, in contrast to embodiment 3 in which needle crystals 15 are disposed on scan electrodes 121 and sustain electrodes 122, the present embodiment differs in that electron emitting electrodes 123 are provided between scan electrodes 121 and sustain electrodes 122, with needle crystals 15 being disposed on these electron emitting electrodes 123.

That is, needle crystals 15 composed of a conductive substance or a semiconductor substance are disposed in an upright position on electron emitting electrodes 123, as shown in FIGS. 12A and 12B. Needle crystals 15 penetrate dielectric film 13, forming a phase-separated structure with dielectric film 13 and protective film 14.

Needle crystals 15 can be disposed in an upright position on the surface of electron emitting electrodes 123 by dispersedly forming a catalyst layer 16 on the surface of electron emitting electrodes 123, and growing graphite particles on catalyst layer 16, similarly to the method described in embodiment 3.

Note that in the example shown in FIG. 12B, needle crystals 15 are disposed on the surface of electron emitting electrodes 123 only in positions corresponding to a central portion (regions A enclosed by dotted lines) of the discharge cells, although the crystals may be disposed over the entire surface of electron emitting electrodes 123.

Furthermore, in the example shown in FIG. 12B, protrusions 121*c* and 122*c* facing a central portion of the discharge cells are formed on transparent electrodes 121*a* and 122*a*, and electron emitting electrodes 123 are constituted from transparent electrodes similar to transparent electrodes 121*a* and 122*a*.

In a sustain period when driving the PDP, a sustain pulse is applied alternately to display electrodes 121 and 122, while electron emitting electrodes 123 are held at ground potential or floating potential.

Electric fields are thus formed alternately between scan electrodes 121 and electron emitting electrodes 123, and between sustain electrodes 122 and electron emitting electrodes 123. The electric fields result in electrons being emitted in discharge space 30 from needle crystals 15 on electron emitting electrodes 123. Since the electron density in the discharge space rises as a result, the discharge firing voltage between scan electrodes 121 and sustain electrodes 122 decreases.

Furthermore, the secondary electron emission performance on the surface of protective film 14 improves due to needle crystals 15 on electron emitting electrodes 123.

Moreover, when protrusions 121*c* and 122*c* are formed on transparent electrodes 121*a* and 122*a*, the electric fields formed on electron emitting electrodes 123 when pulse voltages are applied to scan electrodes 121 and sustain electrodes 122 are enlarged.

The formation density of needle crystals 15 on the surface of electron emitting electrodes 123 preferably is 30% to 90%, and more preferably 60% or less, similarly to that described in embodiment 3.

Similarly to embodiment 3, by setting a high Xe density, high luminous efficiency is obtained while keeping the discharge firing voltage low, even in a PDP provided with front panel 10 of the present embodiment. As a result, it is possible to greatly reduce power consumption in the PDP.

For example, in a PDP having a conventional configuration without needle crystals disposed on the electrodes, the discharge firing voltage was measured at 220 V when 10% Xe+90% Ne was employed as the discharge gas. However, in a PDP with a phase-separated structure formed by disposing needle crystals on electron emitting electrodes 123 as in the present embodiment, the discharge firing voltage was kept low at 160 V even when 10% Xe+90% Ne was employed as the discharge gas.

Applicability as FED Electron Source

In the above embodiments 1 to 5, a phase-separated structure composed of needle crystal particles and metal oxides that fill the gaps between the particles is provided on the electrodes, although a phase-separated structure with similar constitution can also be utilized as the electron source for a field emission display (FED).

That is, even in the electron source for a FED, the particles are mechanically reinforced by filling the gaps between the particles with a metal oxide having a large secondary electron emission coefficient after disposing the particles in an upright position on a substrate. Consequently, a highly efficient electron source is obtained, along with suppressing lateral movement.

INDUSTRIAL APPLICABILITY

The present invention is effective in reducing power consumption in large, thin display panels while improving display quality, because of enabling a reduction in discharge firing voltage to be achieved while suppressing the occurrence of discharge variability in a PDP when driven.

The invention claimed is:

1. A plasma display panel comprising:

a front substrate and a back substrate that face each other with a space therebetween, the front substrate having a plurality of electrodes disposed on a main surface thereof, including a display electrode pair and an electron emitting electrode formed between the display electrode pair; and a dielectric film and a protective film formed sequentially to cover the electrodes, and luminescent display being performed by applying a voltage to the electrodes to cause a discharge in the space between the substrates, characterized in that:

a plurality of needle crystals composed of a conductive substance or a semiconductor substance are disposed on the electron emitting electrode to reach the protective film by penetrating the dielectric film in a thickness direction from a surface of the electrodes, wherein the needle crystals are disposed substantially perpendicular to the main surface of the front substrate to penetrate the dielectric film in a thickness direction, and a material of the dielectric film and a material of the protective film are layered to completely fill gaps between the needle crystals.

2. The plasma display panel of claim 1, wherein the protective film material and the needle crystals form a phase-separated structure.

3. The plasma display panel of claim 1, wherein the needle crystals are graphite crystals.

4. The plasma display panel of claim 1, wherein a metal layer composed of one or a plurality of metals selected from the group consisting of iron, cobalt, and nickel is interposed between the dielectric film and the needle crystals.

5. The plasma display panel of claim 3, wherein the graphite crystals are one member selected from the group consisting of carbon nanotubes, graphite nanofibers, and diamond-like carbon.

6. The plasma display panel of claim 1, wherein the needle crystals are tetrapod-shaped particles.

7. The plasma display panel of claim 6, wherein the particles are composed of zinc oxide.

8. The plasma display panel of claim 1, wherein tips of the needle crystals are exposed above the surface of the protective film.

9. The plasma display panel of claim 1, wherein tips of the needle crystals are buried in the protective film.

10. The plasma display panel of claim 1, wherein the dielectric film material and the needle crystals form a phase-separated structure.

11. The plasma display panel of claim 10, wherein the needle crystals are graphite crystals.

12. The plasma display panel of claim 11, wherein a metal layer composed of one or a plurality of metals selected from the group consisting of iron, cobalt, and nickel is interposed between the electrodes and the needle crystals.

13. The plasma display panel of claim 11, wherein the graphite crystals are one member selected from the group consisting of carbon nanotubes, graphite nanofibers, and diamond-like carbon.

14. The plasma display panel of claim 1, wherein when generating a sustain discharge in the space between the substrates, a sustain voltage is applied to the display electrodes, while holding the electron emitting electrode at one of ground potential and floating potential.

15. The plasma display panel of claim 1, wherein the protective film is composed of one or a compound of metal oxides selected from the group consisting of magnesium oxide, calcium oxide, strontium oxide, and barium oxide.

* * * * *